US007497730B2

(12) United States Patent
Kobayashi et al.

(10) Patent No.: US 7,497,730 B2
(45) Date of Patent: Mar. 3, 2009

(54) OUTER CONDUCTOR TERMINAL

(75) Inventors: Kazumasa Kobayashi, Yokkaichi (JP); Ryoya Okamoto, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/812,758

(22) Filed: Jun. 21, 2007

(65) Prior Publication Data

US 2008/0124972 A1 May 29, 2008

(30) Foreign Application Priority Data

Jun. 23, 2006 (JP) ..... 2006-173569
Nov. 2, 2006 (JP) ..... 2006-298345

(51) Int. Cl.
*H01R 9/05* (2006.01)

(52) U.S. Cl. ..... 439/585; 439/877; 439/878

(58) Field of Classification Search ..... 439/585, 439/877, 878
See application file for complete search history.

(56) References Cited

U.S. PATENT DOCUMENTS 5,281,760 A * 1/1994 Kikuchi et al. ..... 174/74 R
6,206,727 B1 * 3/2001 Aoyama et al. ..... 439/585
6,554,644 B2 * 4/2003 Koide ..... 439/585

FOREIGN PATENT DOCUMENTS

JP A 2003-173850 6/2003
JP A 2006-318788 11/2006

* cited by examiner

*Primary Examiner*—Tho D Ta
*Assistant Examiner*—Travis Chambers
(74) *Attorney, Agent, or Firm*—Oliff & Berridge, PLC

(57) ABSTRACT

An outer conductor terminal by which locking force of its crimping pieces at a braid section of a coaxial wire is improved, preventing the coaxial wire from being pulled out of the terminal. The outer conductor terminal, which is attached to an end of a coaxial wire having an inner conductor, an outer conductor as a braid provided around the inner conductor via insulation, and a sheath covering the braid, has a crimp section having a pair of crimping pieces which are made to overlap on and crimped onto an end of the braid of the coaxial wire, wherein an edge portion of the inside crimping piece of the outer conductor terminal on a terminal top side locks the end of the braid.

8 Claims, 12 Drawing Sheets

OUTER CONDUCTOR TERMINAL

BACKGROUND OF THE INVENTION

1. Field of the Invention

The present invention relates to an outer conductor terminal, and specifically relates to an outer conductor terminal preferably used for a coaxial wire which transmits a high-frequency electric signal.

2. Description of Related Art

In recent years, for a wiring member which transmits an electric signal from electric equipment and the like incorporated into an automobile, a coaxial connector in which a terminal is attached to an end of a coaxial wire is generally used because it is resistant to an influence of a noise and capable of transmitting a high-frequency electric signal.

As shown in FIG. 12, a coaxial wire 72 includes an inner conductor 78 which transmits an electric signal, a braid 82 as an outer conductor which is provided around the inner conductor 78 in order to shield the inner conductor 78 from an extraneous noise, insulation 80 which is interposed between the inner conductor 78 and the braid 82 to electrically insulate them, and a sheath 84 which covers the braid 82. At an end of the coaxial wire 72, an inner conductor terminal 74 is connected to the inner conductor 78, and an outer conductor terminal 76 is connected to the braid 82, thereby constituting a coaxial connector 70.

The outer conductor terminal 76, having crimping pieces for solderless connection with the coaxial wire 72, is connected to the coaxial wire 72 by crimping the crimping pieces onto the sheath 84 and the braid 82 (see Japanese Patent Application Unexamined Publication No. 2003-173850). To be specific, crimping pieces 86*a* and 86*b* are crimped onto the braid 82, and crimping pieces 88*a* and 88*b* are crimped onto the sheath 84.

However, the crimping pieces 86*a* and 86*b* are not firmly crimped onto the braid 82 because the purpose of crimping is to obtain electrical connection between the braid 82 of the coaxial wire 72 and the outer conductor terminal 76, and it is preferable not to change a coaxial structure of the coaxial wire 72 as much as possible. In addition, in the coaxial wire 72, the sheath 84 is prone to slide on the braid 82, so that a deviation between the sheath 84 and the braid 82 tends to occur.

Therefore, when tensile force is developed on the coaxial wire 72, there is a possibility that tensile force is exerted on the braid 82 inside the sheath 84, pulling the braid 82 out of the crimping pieces 86*a* and 86*b*, even though the sheath 84 is fixed by the crimping pieces 88*a* and 88*b*. In addition, when tensile force is exerted also on the insulation 80 and the inner conductor 78 inside the braid 82, there is a possibility that the inner conductor 78 is pulled out of the inner conductor terminal 74. Consequently, there is a problem that locking force is insufficient with a lock structure of the coaxial wire 72 with the crimping pieces 88*a* and 88*b* at the sheath 84 section.

SUMMARY OF THE INVENTION

An object of the invention is to overcome the problems described above and to provide an outer conductor terminal by which locking force of its crimping pieces at a braid section of a coaxial wire is improved, preventing the coaxial wire from being pulled out of the terminal.

To achieve the objects and in accordance with the purpose of the present invention, an outer conductor terminal, which is attached to an end of a coaxial wire having an inner conductor, an outer conductor as a braid provided around the inner conductor via insulation and a sheath covering the braid, has a crimp section having a pair of crimping pieces which are made to overlap on and crimped onto an end of the braid of the coaxial wire, wherein an edge portion of the inside crimping piece on a terminal top side locks the end of the braid.

It is preferable that the crimp section further has, in a section where the end of the braid is located, a push-up projection which pushes up the end of the braid toward the crimping pieces overlapping on the end of the braid.

In addition, it is preferable that the crimping pieces are formed so that the width of the inside crimping piece is made smaller than the width of the outside crimping piece.

It is preferable that the crimping pieces are formed so that the outside crimping piece is positioned on the terminal top side relative to the inside crimping piece.

The coaxial wire is apt to generate a deviation between the sheath and the braid, and the crimping pieces are not firmly crimped onto the braid when the outer conductor terminal is crimped onto the coaxial wire. Therefore, locking force is insufficient with a lock structure of the coaxial wire with the crimping pieces in the sheath section. In view of this, the outer conductor terminal according to the present invention includes the crimp section having the crimping pieces which are made to overlap on and crimped onto the end of the braid of the coaxial wire, wherein the edge portion of the inside crimping piece on the terminal top side locks the end of the braid. As a result, locking force of the crimping piece of the outer conductor terminal at the braid section of the coaxial wire is improved, preventing the coaxial wire from being pulled out of the terminal.

If the push-up projection which pushes up the end of the braid toward the crimping pieces overlapping on the end of the braid is provided in the section where the end of the braid is located, by crimping the crimp section of the outer conductor terminal onto the braid of the coaxial wire, the end of the braid is pushed up toward the crimping pieces overlapping on the end of the braid so as to be locked by the edge portion of the crimping piece on the terminal top side. As a result, locking force of the crimping piece of the outer conductor terminal at the braid section of the coaxial wire is improved, preventing the coaxial wire from being pulled out of the terminal.

In addition, if the crimping pieces are formed so that the width of the inside crimping piece is made smaller than the width of the outside crimping piece, when the crimp section of the outer conductor terminal is crimped onto the braid of the coaxial wire, the edge portion of the inside crimping piece is brought into intimate contact with the braid without being warped upward, catching the braid sufficiently. As a result, locking force of the crimping piece of the outer conductor terminal at the braid section of the coaxial wire is improved, preventing the coaxial wire from being pulled out of the terminal.

In addition, if the crimping pieces are formed so that the outside crimping piece is positioned on the terminal top side relative to the inside crimping piece, the outer conductor terminal can be crimped onto and connected to the coaxial wire in such a manner that the edge portion of the inside crimping piece on the terminal top side is covered by the outside crimping piece, without making the width of the inside crimping piece smaller than the width of the outside crimping piece. Therefore, the edge portion of the inside crimping piece is brought into intimate contact with the braid without being warped upward, catching the braid sufficiently. As a result, locking force of the crimping piece of the outer conductor terminal at the braid section of the coaxial wire is improved, preventing the coaxial wire from being pulled out of the terminal. In addition, the width of the inside crimping piece is ensured, further improving locking force of the crimp piece of the outer conductor terminal at the braid section of the coaxial wire.

Additional objects and advantages of the invention are set forth in the description which follows, are obvious from the description, or may be learned by practicing the invention. The objects and advantages of the invention may be realized and attained by the outer conductor terminal in the claims.

BRIEF DESCRIPTION OF THE DRAWINGS

The accompanying drawings, which are incorporated in and constitute a part of this specification, illustrate embodiments of the present invention and, together with the description, serve to explain the objects, advantages and principles of the invention. In the drawings.

DETAILED DESCRIPTION OF THE PREFERRED EMBODIMENTS

Figure 1:
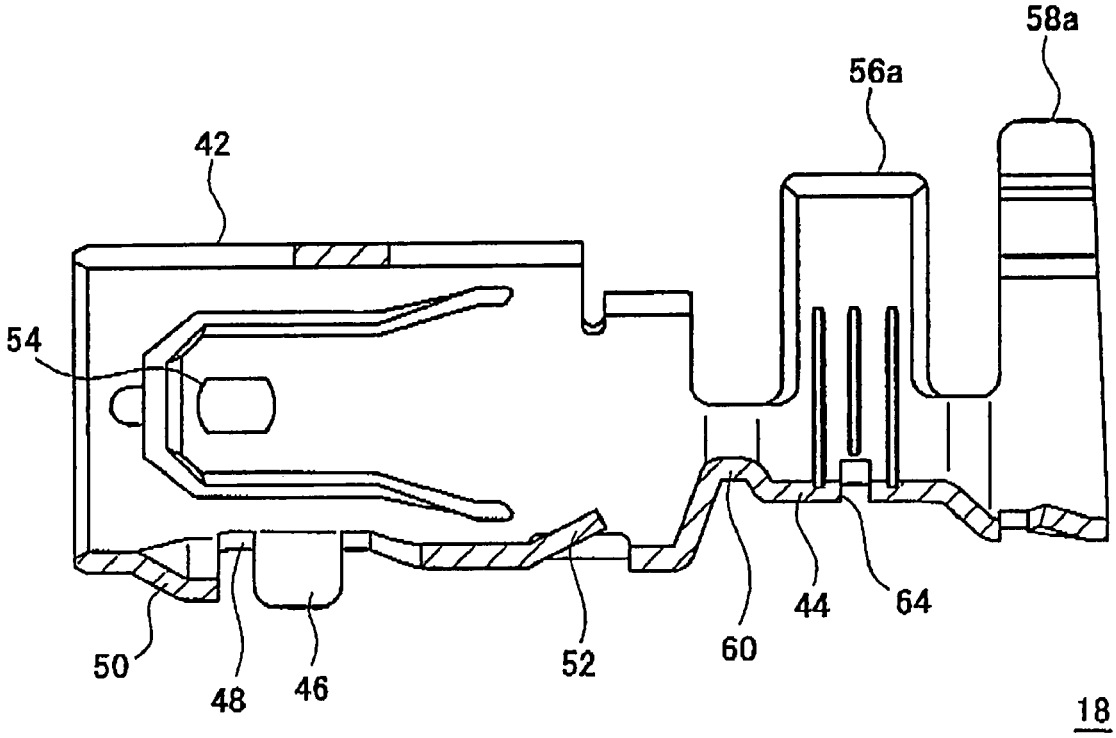
FIG. 1 is a sectional view showing an outer conductor terminal according to a first embodiment of the present invention.
Figure 2A:
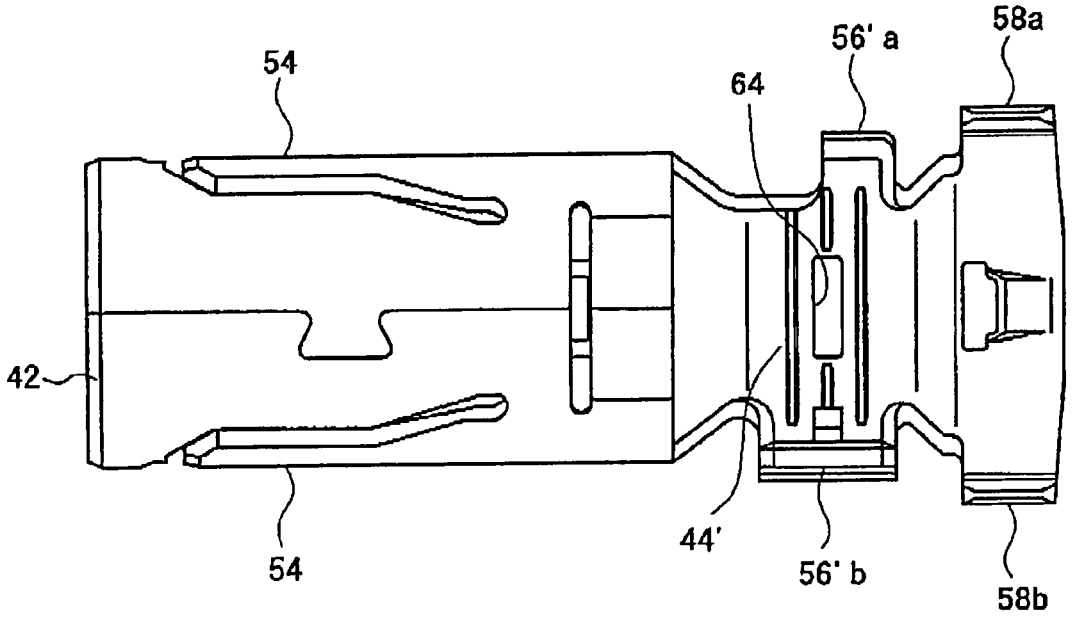
FIG. 2A is a plan view showing an outer conductor terminal according to a second embodiment of the present invention.
Figure 2B:
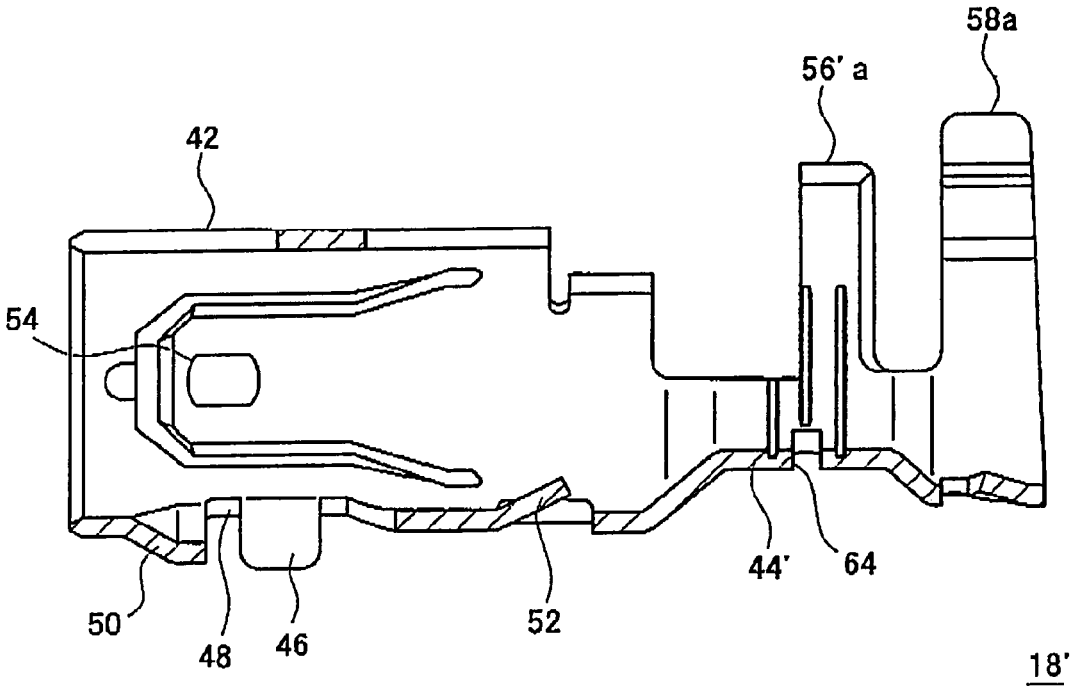
FIG. 2B is a sectional view showing the same.
Figure 3:
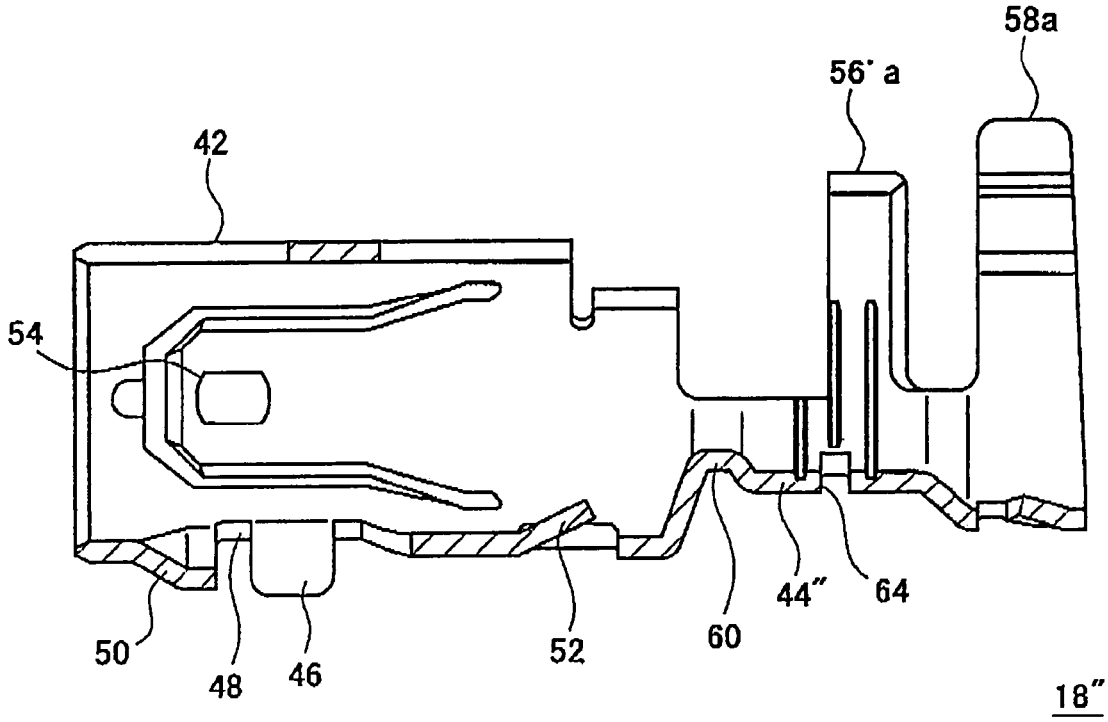
FIG. 3 is a sectional view showing an outer conductor terminal according to a third embodiment of the present invention.
Figure 4:
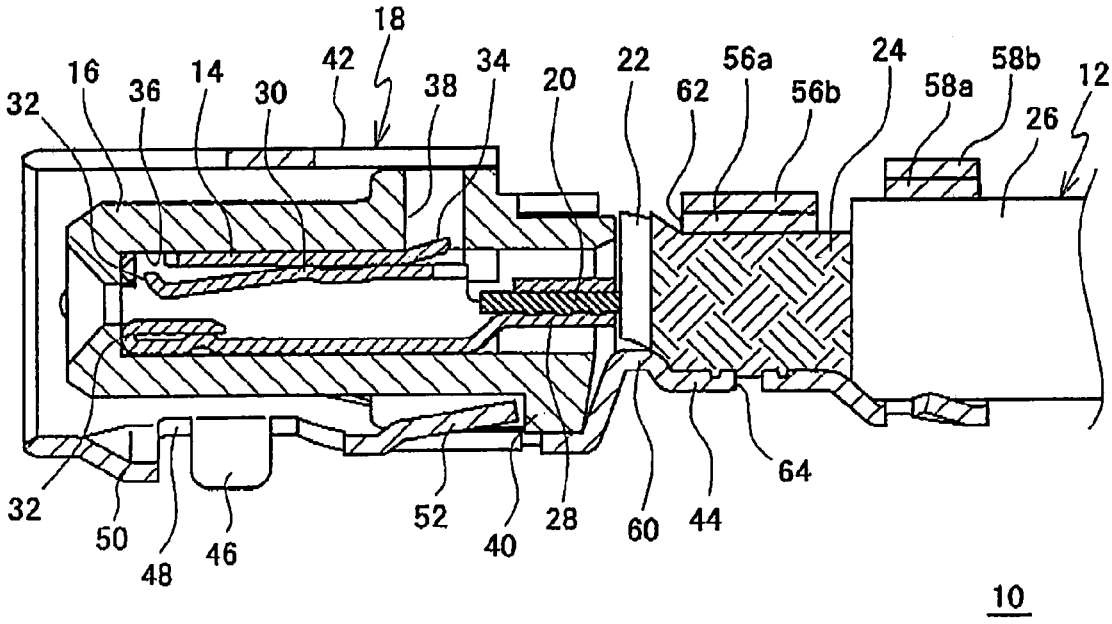
FIG. 4 is a sectional view showing a state when the outer conductor terminal according to the first embodiment is crimped onto an end of a coaxial wire.
Figure 5:
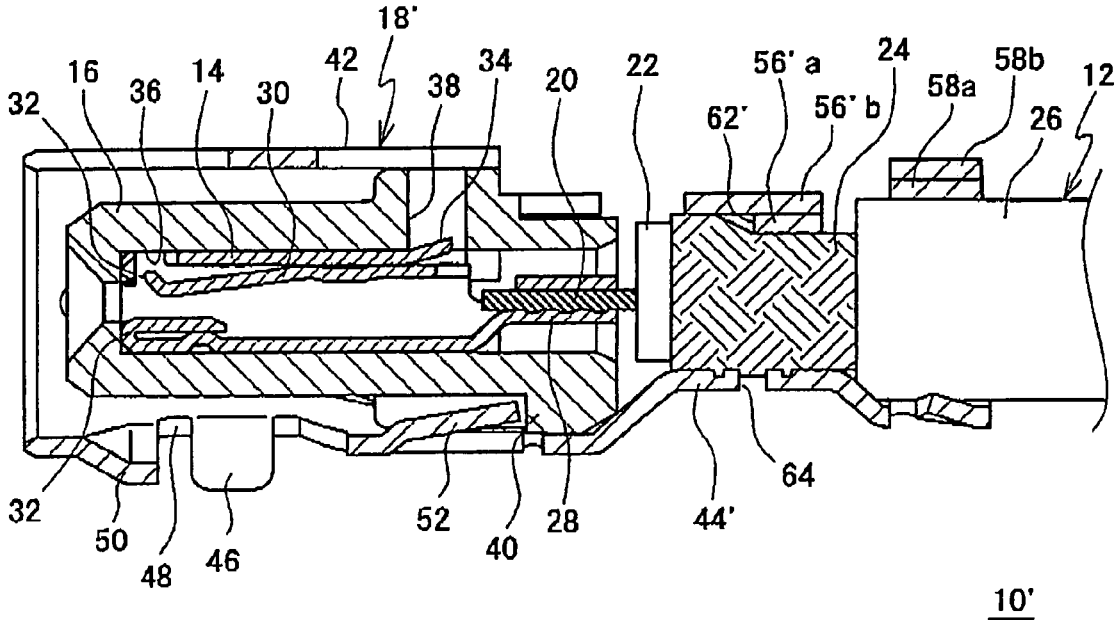
FIG. 5 is a sectional view showing a state when the outer conductor terminal according to the second embodiment is crimped onto the end of the coaxial wire.
Figure 6:
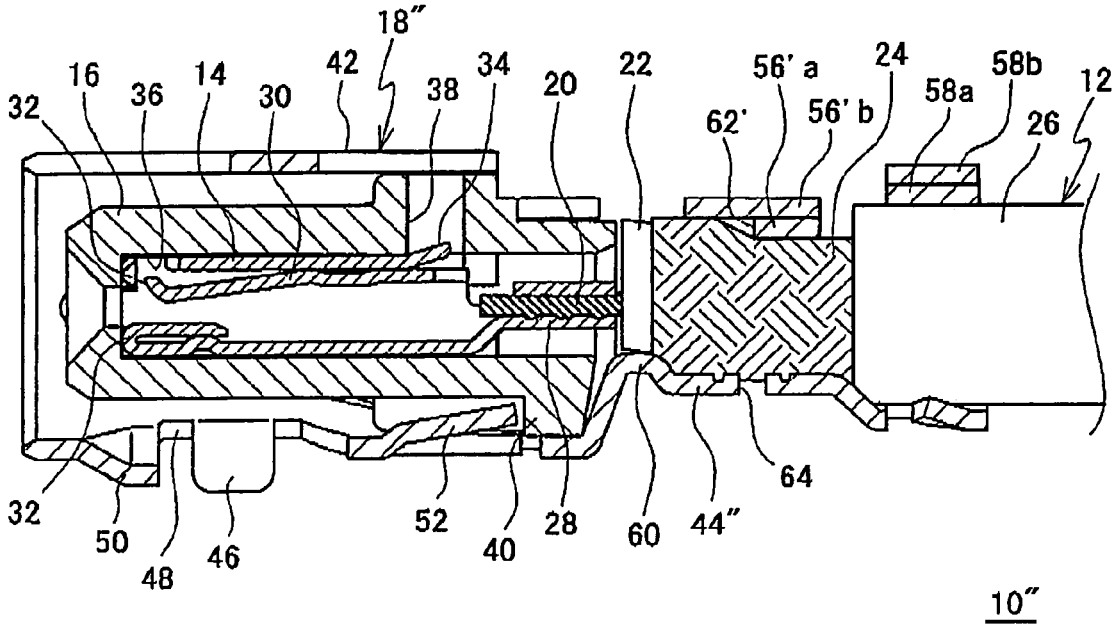
FIG. 6 is a sectional view showing a state when the outer conductor terminal according to the third embodiment is crimped onto the end of the coaxial wire.

A detailed description of preferred embodiments of an outer conductor terminal embodied by the present invention is provided below with reference to the accompanying drawings. FIG. 1 is a sectional view showing an outer conductor terminal according to a first embodiment of the present invention. FIG. 2A is a plan view showing an outer conductor terminal according to a second embodiment of the present invention, and FIG. 2B is a sectional view showing the same. FIG. 3 is a sectional view showing an outer conductor terminal according to a third embodiment of the present invention. FIGS. 4 to 6 are sectional views showing a state when the outer conductor terminal consistent with the first, second or third embodiment is crimped onto an end of a coaxial wire. FIGS. 7A to 8B are enlarged sectional views each showing a crimp state of crimping pieces at a braid section. Hereinafter, a direction of fitting to a counterpart coaxial connector is referred to as a terminal top side (a forward side), and a direction opposite to the fitting direction is referred to as a terminal base side (a backward side).

As shown in FIG. 4, in a coaxial connector 10 having an outer conductor terminal 18 according to the first embodiment of the present invention, at an end of a coaxial wire 12, an inner conductor terminal 14 is connected to an inner conductor 20 of the coaxial wire 12, the inner conductor terminal 14 is held by a dielectric 16, the dielectric 16 is incorporated into the outer conductor terminal 18, and the outer conductor terminal 18 is connected to a braid 24 of the coaxial wire 12.

The coaxial wire 12 has a structure in which the inner conductor 20 which is a stranded wire of elemental wires made of copper and the like, an insulation 22 which covers the inner conductor 20, the braid 24 as an outer conductor which is a braided wire of elemental wires made of copper and the like and covers the insulation 22, and a sheath 26 as an exterior covering which covers the braid 24 are arranged coaxially. Since the inner conductor 20 is covered by the braid 24, an extraneous noise and the like can be electromagnetically shielded.

Terminal treatment is provided to the coaxial wire 12 to strip off the sheath 26 over a predetermined length to expose the braid 24, to strip off the exposed braid 24 over a predetermined length to expose the insulation 22, and to strip off the exposed insulation 22 over a predetermined length to expose the inner conductor 20, so that the inner conductor 20, the insulation 22, the braid 24 and the sheath 26 are exposed stepwise as shown in FIG. 4.

The inner conductor terminal 14 which is connected to the inner conductor 20 is a unitary formed member prepared by bending a plate-shaped conductive material, and has at its base end a crimp section 28 which is crimped onto the inner conductor 20 and brought into conduction and connection with the inner conductor 20, and at its top end a connecting section 30 which is brought into conduction and connection with a terminal of a counterpart connector. The connecting section 30 has a pair of inwardly folded contact pieces 32 on the terminal top side. The contact pieces 32 are formed so as to be elastically deformable, and when a tab-shaped contact of the terminal of the counterpart connector is inserted between the contact pieces 32, the contact pieces 32 come into elastic contact with the tab-shaped contact, enabling signal sending/receiving. Above the connecting section 30, a lock piece 34 is formed to project upward so as to be deformable.

The dielectric 16 holds the inner conductor terminal 14 is a unitary formed member substantially in the shape of a cylindrical column which is made from an insulative synthetic resin having a predetermined dielectric constant, and has the function of maintaining insulation between the inner conductor terminal 14 and the outer conductor terminal 18. In the dielectric 16, a terminal housing chamber 36 is formed to run through the dielectric 16 in the longitudinal direction so as to be capable of holding the inner conductor terminal 14. On the upper wall of the dielectric 16 on the terminal base side, a locking hole 38 is formed. The locking hole 38 locks the lock piece 34 of the inner conductor terminal 14 to prevent the inner conductor terminal 14 from being pulled out. On the lower wall of the dielectric 16 on the terminal base side, a locking projection 40 is formed to project downward.

As shown in FIG. 1, the outer conductor terminal 18 which incorporates the dielectric 16 is a unitary formed member prepared by bending a plate-shaped material with conductivity, and has at its top end a shell portion 42 substantially in the shape of a cylinder into which the dielectric 16 is incorporated and at its base end a crimp section 44 which is crimped onto the coaxial wire 12.

On the lower wall of the shell portion 42 on the terminal top side, a stabilizer 46 is formed by cutting and erecting a part of the shell portion 42 downward, and on the terminal top side relative to an opening portion 48 formed by the cut and erection, a guide piece 50 is formed to project downward. The stabilizer 46 is for controlling a direction of inserting the outer conductor terminal 18 into a connector housing for housing the outer conductor terminal 18, and is inserted into a slit formed on the lower wall of the connector housing when the outer conductor terminal 18 is housed in the connector housing. The guide piece 50 is for guiding the stabilizer 46 to the slit when the outer conductor terminal 18 is inserted into the connector housing. On the lower wall of the shell portion 42 on the terminal base side, a lock piece 52 is formed upward so as to be deformable, and engages with the locking projection 40 formed to project downward on the lower wall of the dielectric 16 on the terminal base side, whereby the dielectric 16 can be held in the shell portion 42. Respectively on both the side walls of the shell portion 42, contact pieces 54 shaped like a tongue which are capable of elastic contact with the terminal of the counterpart connector are formed.

In the crimp section 44 of the outer conductor terminal 18, a pair of braid crimping pieces 56*a* and 56*b* shaped like a strip and a pair of sheath crimping pieces 58*a* and 58*b* shaped like a strip are formed to extend from the stepwise lower wall of the crimp section 44. The braid crimping pieces 56*a* and 56*b* are to be crimped onto the braid 24 of the coaxial wire 12, and the sheath crimping pieces 58*a* and 58*b* are to be crimped onto the sheath 26 of the coaxial wire 12. On the crimp section 44, the end of the braid 24 and the end of the sheath 26 of the coaxial wire 12 are mounted. The crimping pieces are broadened toward their ends and are long enough to be wound around coaxial wires with a variety of diameters. The crimping pieces are made to cover the coaxial wire 12 from the both sides, so that the braid crimping pieces 56*a* and 56*b* are made to overlap on the end of the braid 24, and the sheath crimping pieces 58*a* and 58*b* are made to overlap on the end of the sheath 26. Thus, crimping of the crimping pieces is made possible.

On the lower wall of the crimp section 44 on the terminal top side, a push-up projection 60 is formed to project upward. The push-up projection 60 pushes up the end of the braid 24 toward the braid crimping pieces 56*a* and 56*b* overlapping on the end of the braid 24, and the pushed up end of the braid 24 is locked by an edge portion 62 of the inside braid crimping piece 56*a* on the terminal top side. In the middle of the lower wall of the crimp section 44, a through hole 64 is provided, and when the braid crimping pieces 56*a* and 56*b* are crimped onto the braid 24, a part of the braid 24 is embedded in the through hole 64.

Assembly of the coaxial connector 10 including the outer conductor terminal 18 having the configuration as above is made in such a manner that the inner conductor terminal 14 is crimped onto the inner conductor 20 of the coaxial wire 12 which is subjected to stepwise strip, the inner conductor terminal 14 is held within the terminal housing chamber 36 of the dielectric 16 incorporated into the outer conductor terminal 18, and the crimp section 44 of the outer conductor terminal 18 is crimped onto the coaxial wire 12, as shown in FIG. 4. At this time, the braid crimping pieces 56*a* and 56*b* of the crimp section 44 of the outer conductor terminal 18 are made to overlap on the end of the braid 24, and the sheath crimping pieces 58*a* and 58*b* are made to overlap on the end of the sheath 26, and then, the crimping pieces are respectively crimped onto the braid 24 and the sheath 26. When the crimping pieces 56*a* and 56*b* overlapping on the end of the braid 24 are crimped onto the braid 24, the push-up projection 60 formed to project upward on the lower wall of the crimp section 44 on the terminal top side pushes up the end of the braid 24 mounted thereon toward the braid crimping pieces 56*a* and 56*b* overlapping on the end of the braid 24, so that the pushed up end of the braid 24 is locked by the edge portion 62 of the inside braid crimping piece 56*a* on the terminal top side.

The coaxial wire 12 is apt to generate a deviation between the sheath 26 and the braid 24, and since the braid crimping pieces 56*a* and 56*b* are not firmly crimped onto the braid 24 when the outer conductor terminal 18 is crimped onto the coaxial wire 12, locking force of the coaxial wire 12 to the terminal is insufficient with a lock structure with the sheath crimping pieces 58*a* and 58*b* at the sheath 26 section. However, the configuration as above improves locking force of the braid crimping pieces 56*a* and 56*b* of the outer conductor terminal 18 at the braid 24 section of the coaxial wire 12, preventing the coaxial wire 12 from being pulled out of the terminal.

Next, an outer conductor terminal according to the second embodiment of the present invention will be described.

An outer conductor terminal 18' according to the second embodiment of the present invention, which has a pair of braid crimping pieces 56'*a* and 56'*b* which are made to overlap on the end of the braid 24, has a configuration different from that of the outer conductor terminal 18 according to the first embodiment of the present invention in that the width of the inside braid crimping piece 56' a in the longitudinal direction is about half the width of the outside braid crimping piece 56'*b*, and the push-up projection 60 included in the first embodiment is not provided on the lower wall of the crimp section 44 on the terminal top side, as shown in FIGS. 2A and 2B. The other elements that are the same as in the first embodiment are assigned the same reference letters as in the first embodiment, and detailed descriptions thereof are omitted.

Figure 7A:
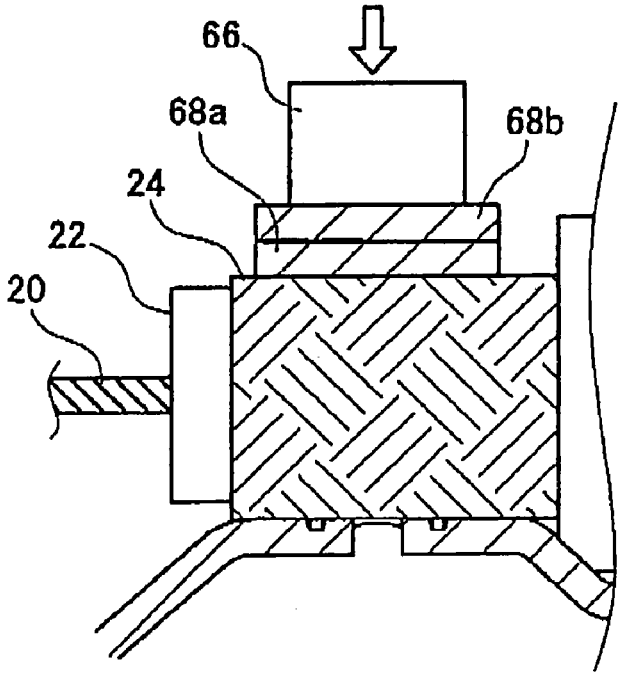
FIGS. 7A and 7B are enlarged sectional views showing a crimping state of crimping pieces at a braid section of a conventional coaxial connector.
Figure 7B:
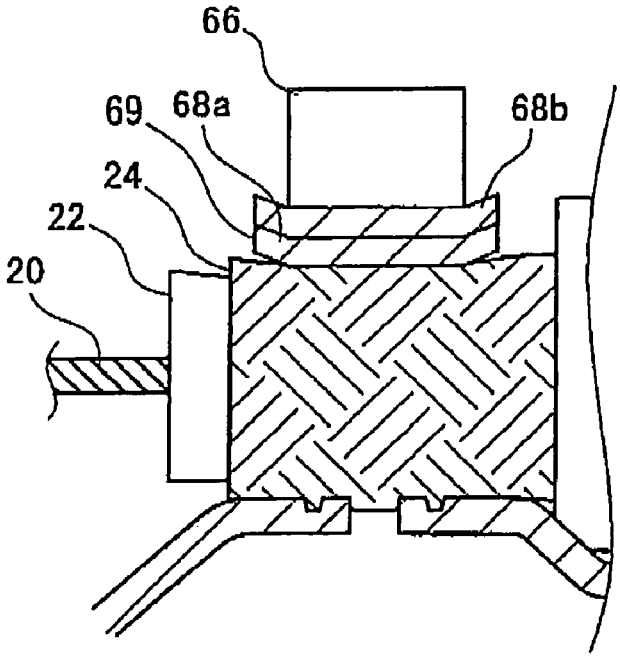

As shown in FIGS. 7A and 7B, generally, braid crimping pieces 68*a* and 68*b* which are made to overlap on and crimped onto the braid 24 are formed such that the width of the inside braid crimping piece 68*a* in the longitudinal direction (the horizontal direction in FIGS. 7A and 7B) is almost the same as the width of the outside braid crimping piece 68*b*. When pressure is applied vertically from above by using a crimper 66 of a crimping device as shown in FIG. 7A and the braid crimping pieces 68*a*and 68*b* are crimped onto the end of the braid 24 (an anvil used in pair with the crimper 66 is placed below, and the braid crimping pieces 68*a* and 68*b* are crimped onto the end of the braid 24 while interposed between the crimper 66 and the anvil), both ends of the braid crimping pieces 68*a* and 68*b* to which pressure is not applied are warped upward (so-called bell mouths are generated) as shown in FIG. 7B. With the both ends of the braid crimping pieces 68*a* and 68*b* being warped upward, an edge portion 69 of the inside braid crimping piece 68*a* on the terminal top side is not brought into intimate contact with the braid 24, so that the edge portion 69 cannot catch the braid 24.

Figure 8A:
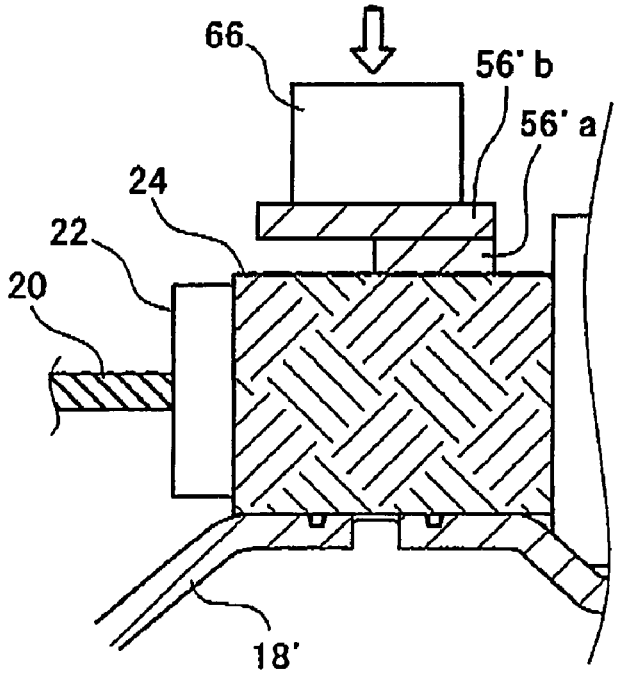
FIGS. 8A and 8B are enlarged sectional views showing a crimping state of crimping pieces at a braid section of a coaxial connector shown in FIG. 5.
Figure 8B:
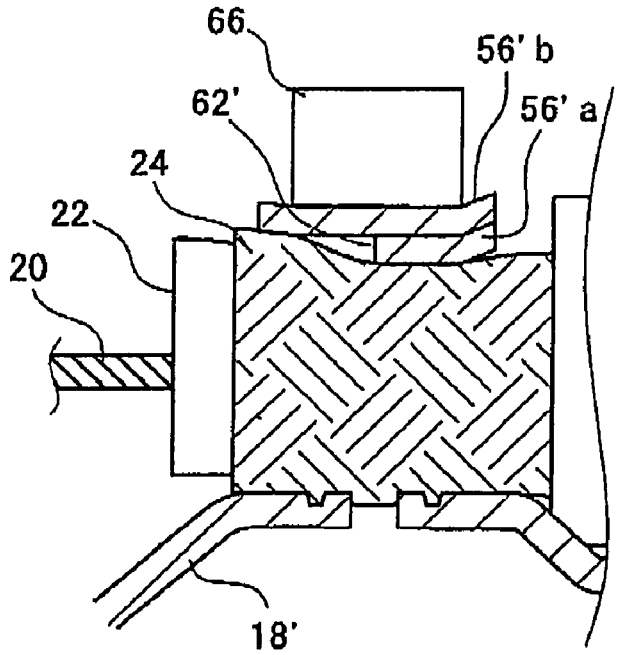

In contrast, the outer conductor terminal 18'according to the second embodiment is formed so that with the braid crimping pieces 56'*a* and 56'*b* overlapping on the end of the braid 24, the width of the inside braid crimping piece 56' a in the longitudinal direction is about half the width of the outside braid crimping piece 56'*b*. Therefore, when pressure is applied to an edge portion 62' of the inside braid crimping piece 56'*a* on the terminal top side by using the crimper 66 of the crimping device as shown in FIG. 5A and the braid crimping pieces 56'*a*and 56'*b* are crimped onto the braid 24, the edge portion 62' of the inside braid crimping piece 56'*a* on the terminal top side is not warped upward as shown in FIG. 8B and is brought into intimate contact with the braid 24, catching the braid 24 sufficiently.

According to the outer conductor terminal 18' having the configuration as above, as shown in FIG. 5, when a crimp section 44' of the outer conductor terminal 18'is crimped onto the braid 24 of the coaxial wire 12, the edge portion 62' of the inside braid crimping piece 56'*a*is not warped upward and is brought into intimate contact with the braid 24, catching the braid 24 sufficiently, so that locking force of the braid crimping piece 56'*a*of the outer conductor terminal 18' at the braid 24 section of the coaxial wire 12 is improved, preventing the coaxial wire 12 from being pulled out of the terminal.

Next, an outer conductor terminal according to the third embodiment of the present invention will be described.

An outer conductor terminal 18" according to the third embodiment of the present invention has, as shown in FIG. 3, the push-up projection 60 which is the characterizing feature of the outer conductor terminal 18 according to the first embodiment as shown in FIG. 1 and the braid crimping pieces 56'*a* and 56'*b* of distinctive shape which are the characterizing features of the outer conductor terminal 18' according to the second embodiment as shown in FIGS. 2A and 2B. To be specific, the push-up projection 60 is formed to project upward on the lower wall of a crimp section 44" on the terminal top side, and with the braid crimping pieces 56'*a* and 56'*b*overlapping on the end of the braid 24, the width of the inside braid crimping piece 56'*a* is about half the width of the outside braid crimping piece 56'*b*. The other elements that are the same as in the first embodiment are assigned the same reference letters as in the first embodiment, and detailed descriptions thereof are omitted.

According to the outer conductor terminal 18" having the configuration as above, which is a configuration in which the action and effect of the outer conductor terminal 18 according to the first embodiment and the action and effect of the outer conductor terminal 18' according to the second embodiment are combined, the edge portion 62'of the inside braid crimping piece 56' a catches the braid 24 more sufficiently as shown in FIG. 6, so that locking force of the braid crimping piece 56'*a* of the outer conductor terminal 18' at the braid 24 section of the coaxial wire 12 is improved, preventing the coaxial wire 12 from being pulled out of the terminal.

Next, an outer conductor terminal according to the fourth embodiment of the present invention will be described.

Figure 9:
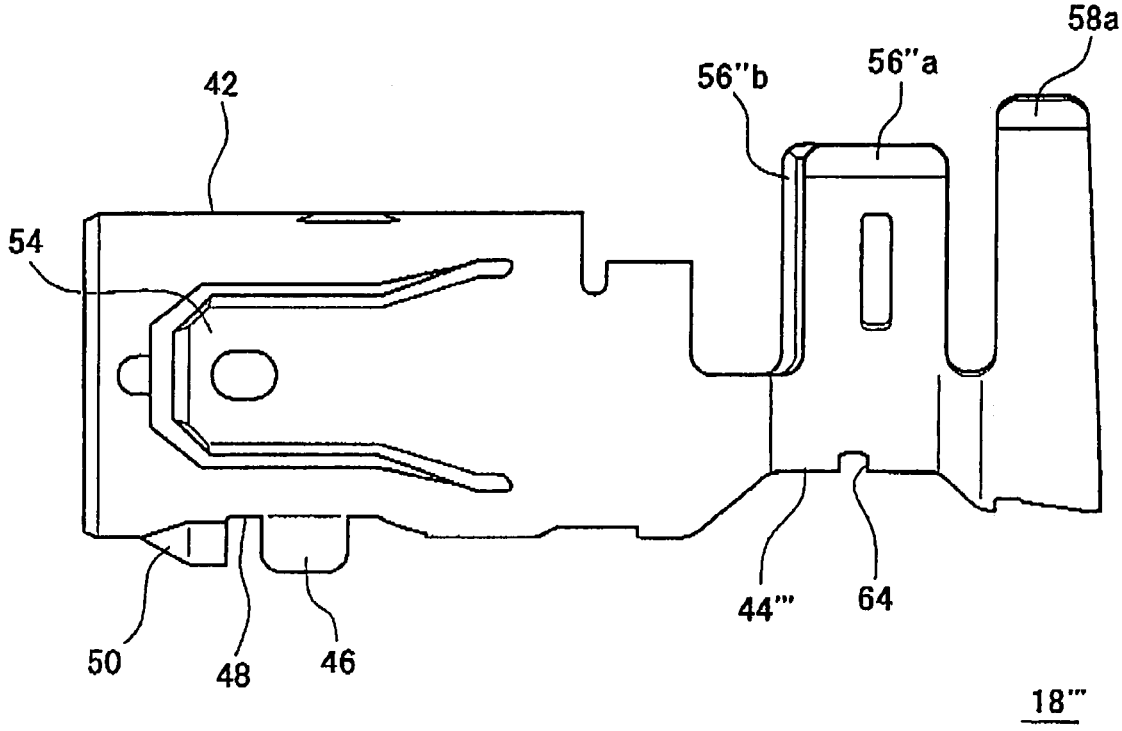
FIG. 9 is a sectional view showing an outer conductor terminal according to a fourth embodiment of the present invention.

An outer conductor terminal 18''' according to the fourth embodiment of the present invention, which has a pair of braid crimping pieces 56"*a* and 56"*b* having almost the same widths which are made to overlap on the end of the braid 24, has a configuration different from that of the outer conductor terminal 18 according to the first embodiment of the present invention in that the inside braid crimping piece 56"*a* is positioned on the terminal base side (the right hand in FIG. 9) relative to the outside braid crimping piece 56"*b*, and the push-up projection 60 provided in the first embodiment is not provided on the lower wall of the crimp section 44 on the terminal top side, as shown in FIG. 9. The other elements that are the same as in the first embodiment are assigned the same reference letters as in the first embodiment, and detailed descriptions thereof are omitted.

As shown in FIGS. 7A and 7B, generally, the braid crimping pieces 68*a* and 68*b* which are made to overlap on and crimped onto the end of the braid 24 have almost the same widths and are placed in almost the same positions in the longitudinal direction (the horizontal direction in FIGS. 7A and 7B). Therefore, as shown in FIG. 7B, when the braid crimping pieces 68*a* and 68*b* are crimped onto the braid 24, bell mouths are generated, so that the edge portion 69 cannot catch the braid 24.

Figure 11A:
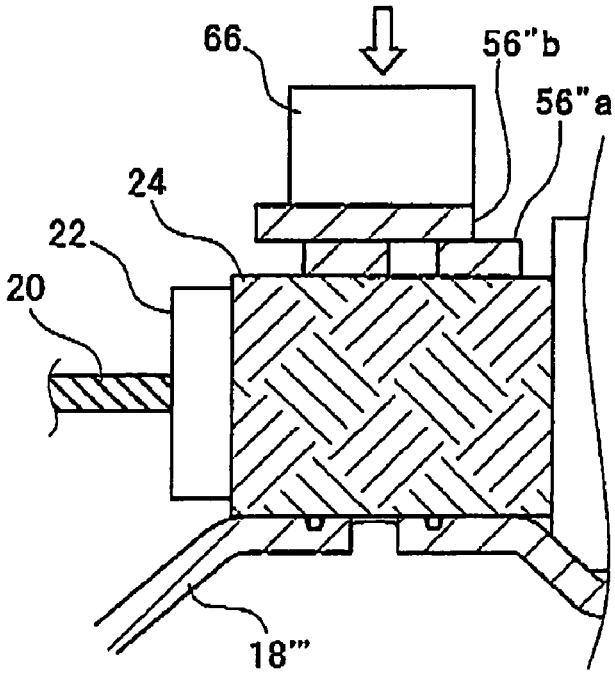
FIGS. 11A and 11B are enlarged sectional views showing a crimping state of crimping pieces at a braid section of a coaxial connector shown in FIG. 10.
Figure 11B:
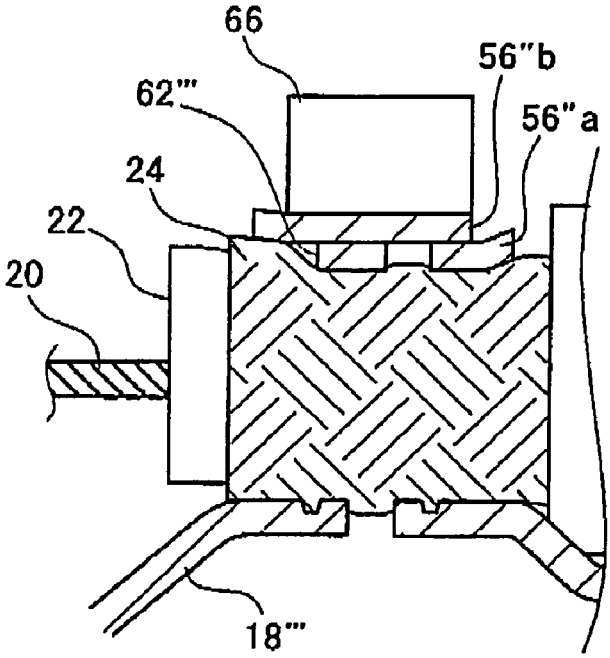
Figure 12:
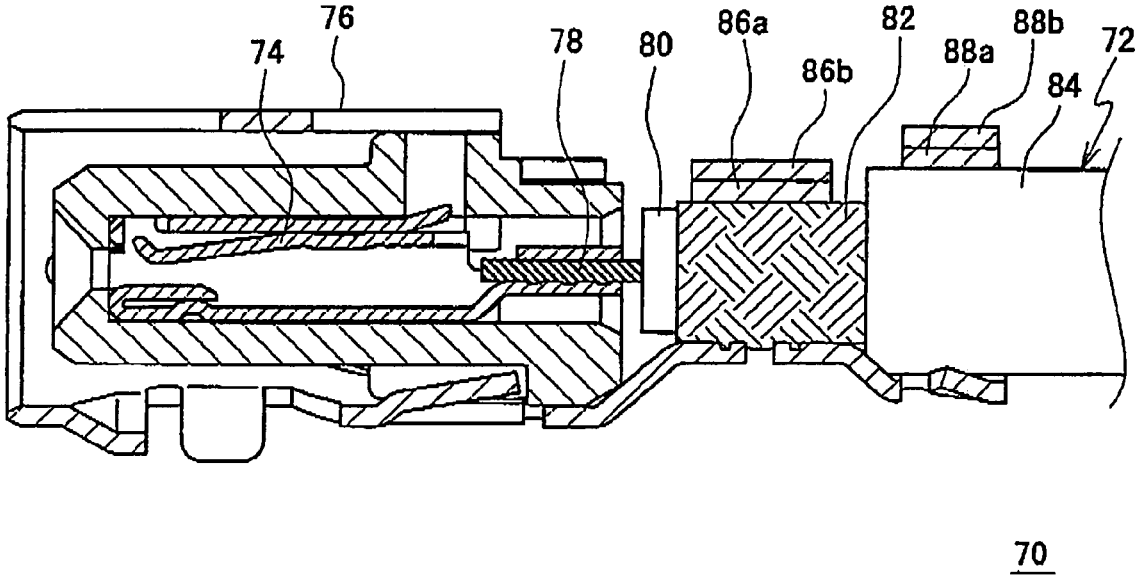
FIG. 12 is a sectional view showing a conventional outer conductor terminal.

In contrast, in the outer conductor terminal 18'''according to the fourth embodiment, with the braid crimping pieces 56"*a* and 56"*b* overlapping on the end of the braid 24, the inside braid crimping piece 56"*a*is positioned on the terminal base side relative to the outside braid crimping piece 56"*b*. Therefore, as shown in FIG. 11A, when pressure is applied vertically from above to the outside braid crimping piece 56"*b* by using the crimper 66 of the crimping device, an edge portion 62''' of the inside braid crimping piece 56"*a* on the terminal top side is covered by the outside braid crimping piece 56"*b*. When the braid crimping pieces 56"*a* and 56"*b* are crimped onto the braid 24 as above, as shown in FIG. 11B, the edge portion 62''' of the inside braid crimping piece 56"*a* is not warped upward and is brought into intimate contact with the braid 24, catching the braid 24 sufficiently.

Figure 10:
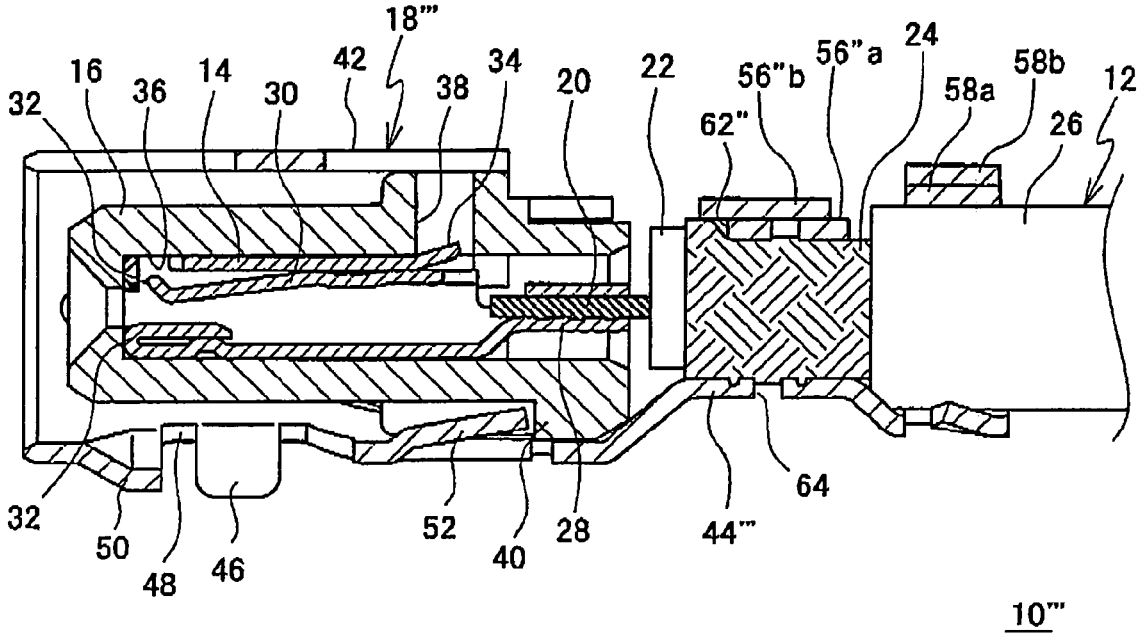
FIG. 10 is a state when the outer conductor terminal according to the fourth embodiment is crimped onto the end of the coaxial wire.

According to the outer conductor terminal 18'''having the configuration as above, as shown in FIG. 10, when a crimp section 44''' of the outer conductor terminal 18''' is crimped onto the braid 24 of the coaxial wire 12, the edge portion 62''' of the inside braid crimping piece 56"*a* is not warped upward and is brought into intimate contact with the braid 24, catching the braid 24 sufficiently and improving fixing force of the outer conductor terminal 18'''. In addition, the width of the inside braid crimping piece 56"*a* of the outer conductor terminal 18''' is larger than the width of the inside braid crimping piece 56' a of the outer conductor terminal 18' or 18" according to the second or third embodiment, so that the area of intimate contact of the inside braid crimping piece 56"*a* with the braid 24 is larger. As a result, locking force is further improved as compared to the braid crimping piece 56'*a* of the outer conductor terminal 18' at the braid 24 section of the coaxial wire 12, preventing the coaxial wire 12 from being pulled out of the terminal.

In the above embodiments, the width of the inside braid crimping piece 56'*a* in the longitudinal direction is about half the width of the outside braid crimping piece 56'*b*; however, the present invention is not limited thereto. It is essential only that the width of the inside braid crimping piece 56'*a* is made smaller to such an extent that pressure by the crimper 66 of the crimping device is applied to the edge portion 62' of the inside braid crimping piece 56'*a* on the terminal top side. In addition, it is needless to say that the outer conductor terminal according to the fourth embodiment may be provided with the push-up projection of the outer conductor terminal according to the first embodiment.

The outer conductor terminal according to the present invention can be used as a terminal for a coaxial wire which is routed through electric equipment and the like incorporated into an automobile.

The foregoing description of the preferred embodiments of the invention has been presented for purposes of illustration and description. It is not intended to be exhaustive or to limit the invention to the precise form disclosed, and modifications and variations are possible in the light of the above teachings or may be acquired from practice of the invention. The embodiments chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A connector which is attached to an end of a coaxial wire having an inner conductor, an outer conductor as a braid provided around the inner conductor via insulation, and a sheath covering the braid, the connector comprising:

an outer conductor terminal located at a terminal top side of the connector, the outer conductor terminal receiving the inner conductor of the coaxial wire, a crimp section located at a terminal base side of the connector opposite to the terminal top side, the crimp section comprising an inside crimping piece crimped onto an end of the braid of the coaxial wire and an outside crimping piece overlapping the inside crimping piece, wherein a terminal top side edge portion of the inside crimping piece is positioned farther towards the terminal base side than a terminal top side edge portion of the outside crimping piece, and the terminal top side edge portion of the inside crimping piece locks the end of the braid.

2. The connector according to claim 1, wherein the crimp section further comprises, at a portion of the crimp section where a terminal top side end of the braid is located, a push-up projection which pushes up the terminal top side end of the braid toward the crimping pieces overlapping on the terminal top side end of the braid.

3. The connector according to claim 1, wherein a width of the inside crimping piece is smaller than a width of the outside crimping piece.

4. The connector according to claim 3, wherein the crimp section further comprises, at a portion of the crimp section where a terminal top side end of the braid is located, a push-up projection which pushes up the terminal top side end of the braid toward the crimping pieces overlapping on the terminal top side end of the braid.

5. The connector according to claim 3, wherein a terminal base side edge portion of the inside crimping piece is aligned with a terminal base side edge portion of the outside crimping piece.

6. The connector according to claim 5, wherein the crimp section further comprises, at a portion of the crimp section where a terminal top side end of the braid is located, a push-up projection which pushes up the terminal top side end of the braid toward the crimping pieces overlapping on the terminal top side end of the braid.

7. The connector according to claim 1, wherein a terminal base side edge portion of the inside crimping piece is positioned farther towards the terminal base side than a terminal base side edge portion of the outside crimping piece.

8. The connector according to claim 7, wherein the crimp section further comprises, at a portion of the crimp section where a terminal top side end of the braid is located, a push-up projection which pushes up the terminal top side end of the braid toward the crimping pieces overlapping on the terminal top side end of the braid.

* * * * *